US008579736B2

(12) United States Patent
Gravel

(10) Patent No.: US 8,579,736 B2
(45) Date of Patent: Nov. 12, 2013

(54) MOVEABLE SOCCER GOAL SAFETY SYSTEM

(76) Inventor: James H. Gravel, The Villages, FL (US)

( * ) Notice: Subject to any disclaimer, the term of this patent is extended or adjusted under 35 U.S.C. 154(b) by 148 days.

(21) Appl. No.: 12/924,711

(22) Filed: Oct. 4, 2010

(65) Prior Publication Data

US 2011/0140363 A1 Jun. 16, 2011

Related U.S. Application Data

(60) Provisional application No. 61/283,850, filed on Dec. 10, 2009.

(51) Int. Cl.
*A63B 63/00* (2006.01)

(52) U.S. Cl.
USPC ..... 473/478; 273/400

(58) Field of Classification Search
USPC ..... 273/398–402; 473/476–478
See application file for complete search history.

(56) References Cited

U.S. PATENT DOCUMENTS

| | | | | |
|---|---|---|---|---|
| 3,399,889 | A * | 9/1968 | Harry | 473/481 |
| 3,743,286 | A * | 7/1973 | Weinhagen et al. | 473/481 |
| 4,786,053 | A * | 11/1988 | Barnes, Jr. | 473/416 |
| 5,580,064 | A * | 12/1996 | Childers, Jr. | 273/400 |
| 6,375,145 | B1 * | 4/2002 | Payne | 248/500 |
| 6,435,512 | B1 * | 8/2002 | Beckwith, Sr. | 273/407 |
| 6,659,892 | B2 * | 12/2003 | Lytle et al. | 473/434 |
| 7,341,531 | B2 * | 3/2008 | Caruso | 473/478 |
| 2004/0036222 | A1 * | 2/2004 | Chou | 273/407 |
| 2007/0078022 | A1 * | 4/2007 | Justice | 473/185 |

* cited by examiner

*Primary Examiner* — Mark Graham
(74) *Attorney, Agent, or Firm* — John M. Brandt

(57) ABSTRACT

In a soccer goal consisting of a framework supporting a net arranged to trap a soccer ball passing through the mouth of the frame upon scoring a goal, a safety device for preventing the shifting of the framework from a playing field position or from tipping over from misuse or player impact consisting of a weighted roller attachable or attached to the rear of the framework and resting on the playing field opposite the mouth which roller is either permanently weighted by construction of a heavy material or is constructed of a sealed shell fillable with a liquid such as water or a flowable particulate substance such as sand. In addition to providing the necessary weight to stabilize the goal, the rollers facilitate the repositioning of the goal for storage or to clear a playing field for other purposes.

7 Claims, 3 Drawing Sheets

MOVEABLE SOCCER GOAL SAFETY SYSTEM

CROSS REFERENCE TO RELATED APPLICATIONS

This application is based on the disclosure of Provisional Application Ser. No. 61/283,850 by the same inventor, filed Dec. 10, 2009 which is hereby incorporated by reference.

BACKGROUND OF THE INVENTION

1. Field of the Invention

The invention generally resides in the field of goal structures used for sport games such as soccer and more particularly relates to devices arranged to secure or anchor such goals against shifting from a designated location on a playing field as well as to prevent tipping over from an upright position which may result in injury to players or others and damage to the goal framework or netting.

2. Description of the Prior Art

Securing goal structures, primarily soccer goal structures, in the proper playing field location and upright position is a substantial safety hazard concern and as such is the subject of a number of prior art disclosures. These goals most often consist of a tubular frame having a top and two sides forming a frontal open mouth and a back spreader bar all of which supports and is enclosed by a netting to trap balls which pass through the mouth when scoring a goal. The frames are inherently unstable and will shift sideways or tip forward and over when subjected to high winds, player impact, or improper use as, for example, climbing on the frame or using the top cross member as a chinning bar.

Typical expedients for preventing unwanted movement of the goals which have a strong potential for causing injury to players or others misusing the equipment include securing the bottom frame members to the ground using stakes or augurs, or weights such as sandbags.

Examples of United States patents disclosing various configurations of devices arranged to be imbedded in the earth of a playing field, either permanently or temporarily, for the purpose of retaining a goal in position are U.S. Pat. No. 4,913,428, Nauman; U.S. Pat. No. 5,820,497, Pena; U.S. Pat. No. 6,082,697, Greenfeld; U.S. Pat. No. 6,308,468, Caruso; and U.S. Pat. No. 6,808,463, Stockwell, III.

Examples of portable weight bags which are draped over one or more of the lower structural bars resting on the playing field are U.S. Pat. No. 6,220,788, Jewell; and U.S. Pat. No. 7,341,531, Caruso. As described herein, applicant proposes a completely different solution which not only stabilizes the goal, but also additionally facilitates relocating it as needed.

SUMMARY OF THE INVENTION

The invention may be summarized as an assembly for a sports goal consisting of one or more weighted rollers or drums rotatably attached to or attachable to the rear framework of a goal composed of a net supporting framework with a front open face or mouth. In contrast to the prior art devices known to the inventor, the rollers not only stabilize the goal by providing added weight, they facilitate moving the structure on a playing field for the purpose of field maintenance such as grass cutting.

The rollers also provide the means to make a field available for other sports by temporarily relocating the goal or moving it to a selected storage area at the end of the season. The rollers are mounted on a cross bar forming an axel which is either an integral part of the goal framework or is attachable thereto as an accessory for retrofitting existing goal structures or as an optional addition to newly manufactured units.

Additionally, these rollers are capable of being tailored in number and size, both length and diameter, to accommodate their use with various goals. For example, a light weight goal might require more or larger rollers to provide sufficient weight to keep the goal in place, while a heavier goal might require smaller or fewer rollers.

These and other features and advantages of the invention will become more clear from the description of the preferred embodiment taken with the drawings which follows.

DESCRIPTION OF THE PREFERRED EMBODIMENT

Figure 1:
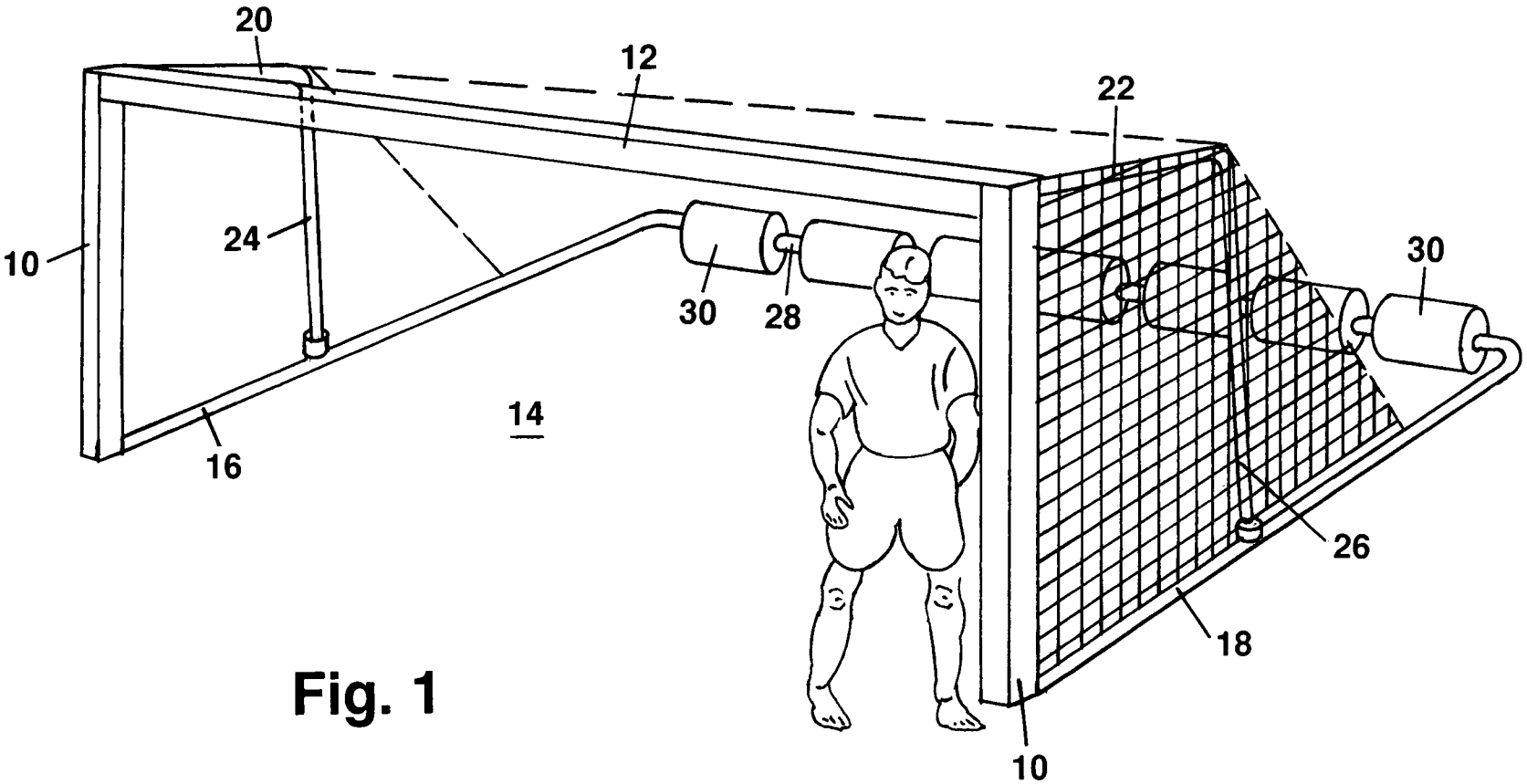
FIG. 1 is a perspective view of the preferred embodiment of the invention.

The preferred embodiment of the invention is illustrated in perspective view by FIG. 1 wherein an outdoor sports goal, more particularly, a portable youth and adult soccer goal is shown consisting of two tubular, relatively lightweight, front round or square side uprights 10 and a front crossbar 12 which together form the goal face or goal mouth 14. Goal face 14 is supported by ground level bars 16 and 18 attached to the bottom of each upright 10 which bars extend back, for example, 8 to 10 feet on each side of goal face 14. Additional supports 20 and 22, extending back 8 feet for example, are attached to the top of each side upright 10, and are further attached to the ground level bars by uprights 24 and 26 to add stability to the goal shape.

In the preferred embodiment of the invention, a crossbar 28, composed of steel or aluminum for example, connects the rear of bars 16 and 18 of the goal and has rotatably mounted thereon one or more cylinders, preferably hollow thick walled cylinders, or rollers 30 composed of a suitable material such as molded polyethylene. The cylinders may be of any size or number appropriate to the structure. A plurality of cylinders 12 inches in diameter by 12 inches long has been found to work well. The thick walled cylinders are fillable with a suitable ballast material such as water or sand to add sufficient weight to inhibit tipping or lateral movement of the goal through impact by players, strong winds, or misuse as described above. It will be understood however that although fillable cylinders are preferred, rollers composed of a heavy solid material may also be employed.

Figure 2:
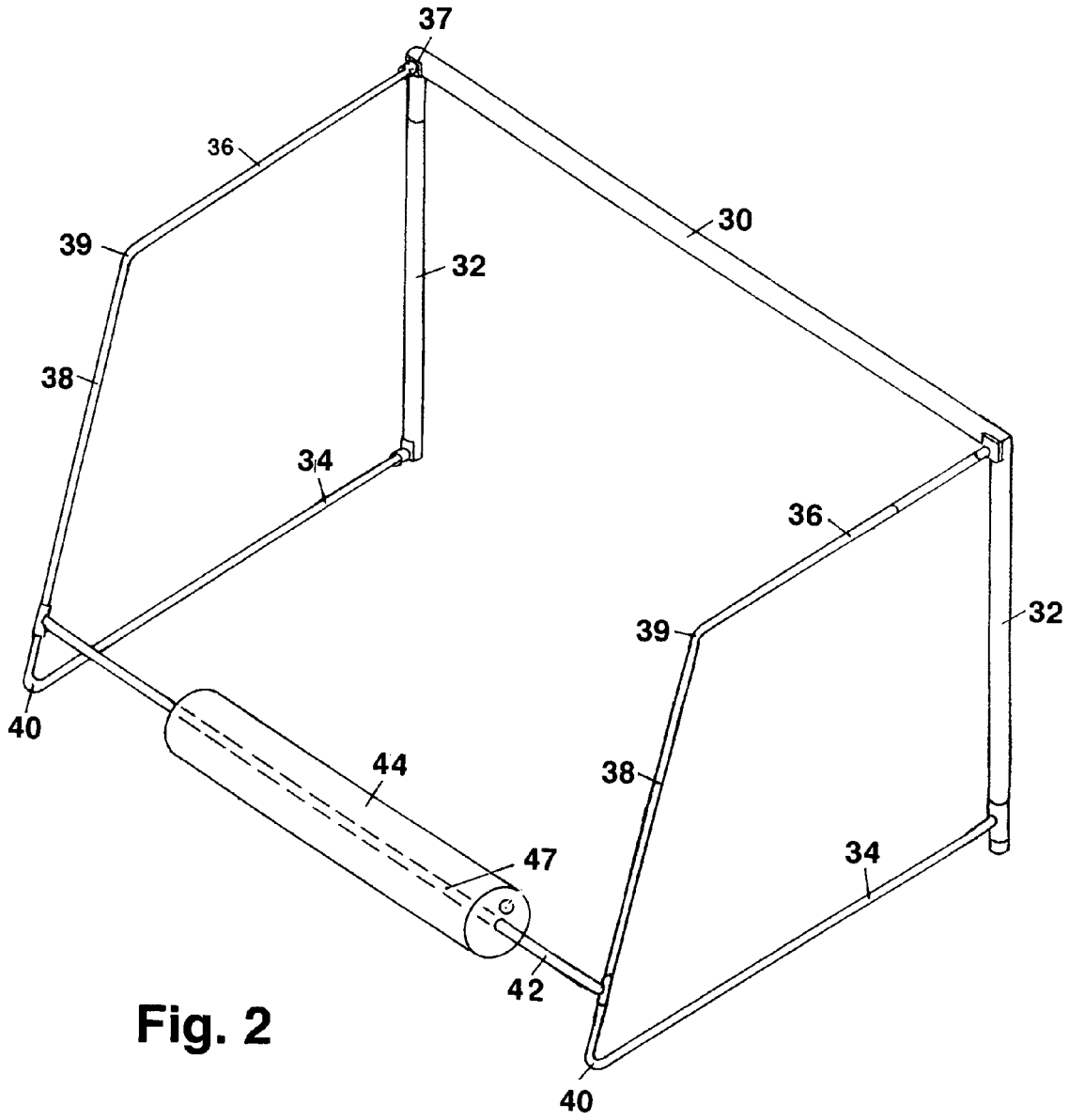
FIG. 2 is a perspective view of an alternative framework suitable for use with the preferred embodiment of the invention.

Referring next to FIG. 2, an alternative framework for a goal structure is illustrated in which front crossbar 30 is supported by front uprights 32 from which ground level bars 34 extend rearward, one on either side of the goal. Top bars 36 also extend rearward from either side of the goal from the intersections 37 of crossbar 30 and uprights 32. Additional rearward upright support bars 38 extend from the rear ends 39 of bars 36 to join the rear ends of ground level bars 34 at intersections 40.

A rear bottom crossbar 42 completes the framework by joining intersections 40. In this embodiment, bottom crossbar 42 provides the axel for a single elongated hollow fillable cylinder 44 whose length and diameter are selected to produce, when filled with ballast, the appropriate counterbalancing weight to prevent unwanted movement of the goal structure.

Figure 3:
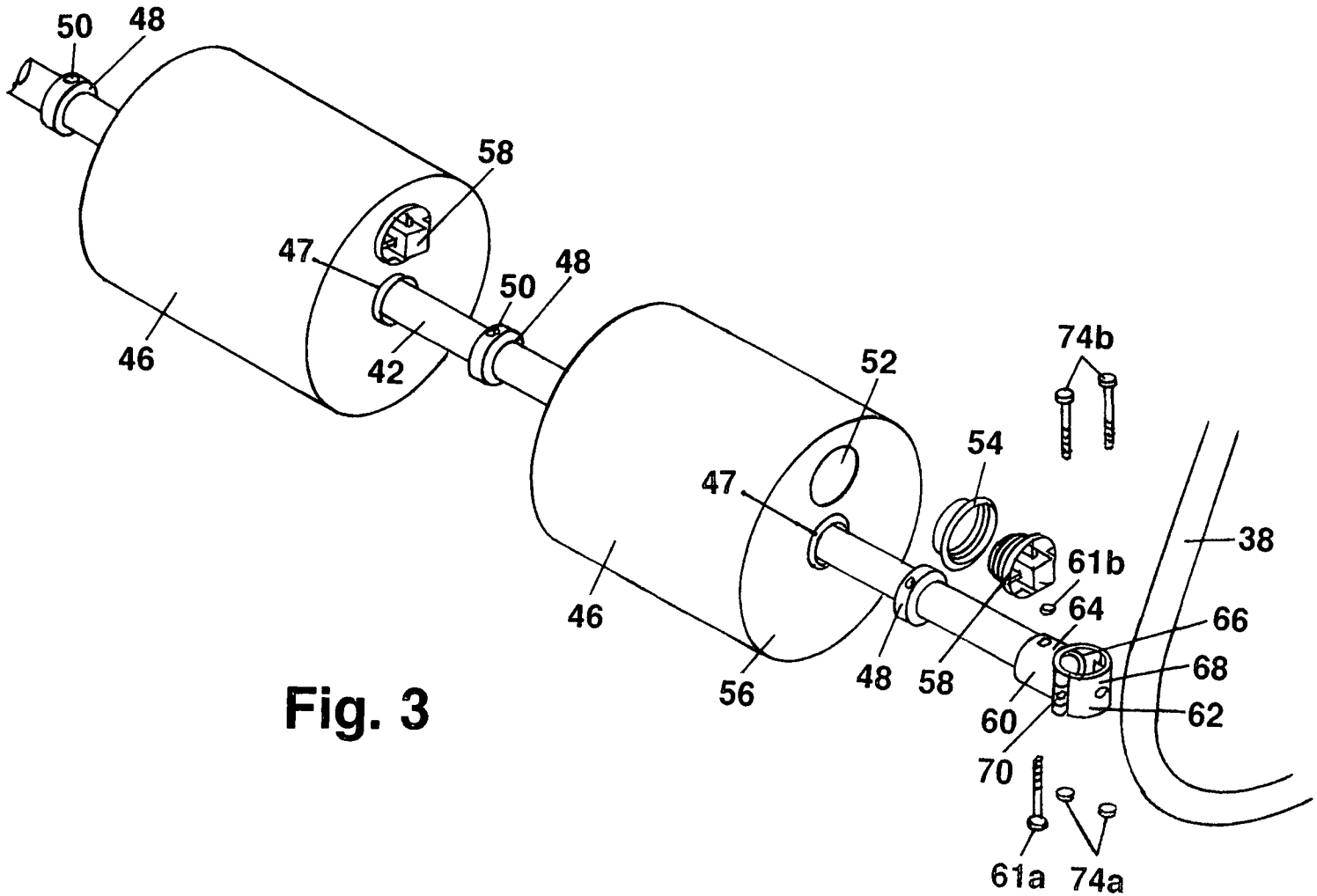
FIG. 3 is a detailed partially exploded perspective view of an assembly incorporating the preferred embodiment of the invention.

FIG. 3 illustrates in detail an arrangement by which bottom crossbar 42 may be joined to the framework of FIG. 2 or added, i.e., retrofitted to any existing goal framework of any configuration either in addition to, as an extension of, or as a complete replacement for an existing crossbar.

As shown, crossbar 42 has ballast fillable rollers 46 rotatably mounted thereon. The rollers, as many as are desired within the limits of their length and the dimensions of the goal framework, are positionable along the crossbar axel by retainer spacing collars 48 held in place by, for example, set screws 50. Each hollow roller or drum is filled through port 52 and the ballast, sand or water for example, retained by threaded flange 54 secured to roller face 56 and threaded cap 58 mating with flange 54. A hub member 47, also shown in FIG. 2, is disposed at the center of each roller face 56 for receiving and providing a rotatable bearing surface for crossbar 42.

Each end of crossbar 42 is attached to the frame by clamp assembly 60 consisting of clamp 62 rotatably attached to collar 64 which is secured to the crossbar by nut 61*a* and bolt 61*b*. Clamp 62 consists of two separable mating halves 66 and 68 each having hinge style end fittings 70 and 72 which are attachable by nut 74*a* and bolt 74*b* sets.

In use, each clamp half 66 and 68 of an appropriate shape and size surrounds a goal frame member 38, clamp 62 rotating into a compatible angular frame member orientation, at a suitable height for the diameter of the rollers which is then secured by the nut and bolt sets.

In order to achieve the one of the primary goals of the invention to prevent tipping of the framework forward, it is important that the rollers or cylinders be mounted on the goal framework rearward of the center of gravity (from front to back) of the framework. The further back the position of mounting, the more effective the use of the cylinders will be for any particular weight.

Variations in the above-described preferred embodiment may be made within the general concept of the disclosure. For example, although it is preferable to employ hollow, fillable cylinders, it is also possible to use cylinders composed of a solid material. Similarly, the number and size of the cylinders may be that most suitable for the goal structure they are used with. Also, the manner in which the rollers or drums are mounted on the framework may vary using, for example, individual roller-axel combinations attached to any appropriate portion of the framework. The invention is therefore accordingly defined by the following claims.

What is claimed is:

1. A soccer goal framework arranged to rest on a playing field ground base, said framework for supporting an enclosing net, comprising in combination:

A. two spaced apart front upright support members:

B. a front cross support member connected between the tops of each of said front upright support members forming a frontal opening for said goal;

C. two spaced apart bottom support members connected one each to the bottom of each of said front upright support members and extending rearward from said front upright support members;

D. two spaced apart top support members connected one each to the top of each of said front upright support members and extending rearward from said front upright support members;

E. two rear upright support members connected one each to the rearward ends of each of said top and bottom support members, each set of front upright support members, rear upright support members, bottom support members, and top support members forming a side framework for said goal;

F. a rear cross bar support member having a longitudinal axis joining the rearward portions of each of said side frameworks in spaced apart relationship; and G. at least one weighted cylinder rotationally mounted on said rear crossbar support member, said at least one weighted cylinder positioned to rest on said ground base to facilitate non-lateral relocation of position of said soccer goal framework by rotation of said at least one weighted cylinder on the ground base, said at least one weighted cylinder further positioned rearward of the center of gravity of said framework, said weighted roller comprising a hollow thick walled sealed cylinder fillable with ballast, said cylinder having a cylindrical outer surface bounded by two spaced apart roller face end members, said cylinder further including a framework member receiving hub disposed in the center of each of said end members;

said soccer goal framework further including at least one additional weighted cylinder separated from said weighted cylinder by a retainer spacing collar slideably mounted on said rear cross member, said collar having an outer diameter greater than that of said rear support cross member, said collar having means to secure said collar at any selected position on said cross member; and wherein said weighted cylinders are configured to:

i. inhibit the forward tipping and the shifting of said soccer goal framework over said playing field ground base;

ii. facilitate the relocation of the position of said soccer goal framework by rotation of said cylinders; and iii. prevent the removal of said cylinders from said soccer goal framework.

2. The soccer goal framework of claim 1 wherein said ballast comprises water.

3. The soccer goal framework of claim 1 wherein said ballast comprises sand.

4. A soccer goal framework arranged to rest on a playing field ground base, said framework for supporting an enclosing net, comprising in combination:

A. two spaced apart front upright support members:

B. a front cross support member connected between the tops of each of said front upright support members forming a frontal opening for said goal;

C. two spaced apart bottom support members connected one each to the bottom of each of said front upright support members and extending rearward from said front upright support members;

D. two spaced apart top support members connected one each to the top of each of said front upright support members and extending rearward from said front upright support members;

E. two rear upright support members connected one each to the rearward ends of each of said top and bottom support members, each set of front upright support members, rear upright support members, bottom support members, and top support members forming a side framework for said goal;

F. a rear cross support member having a longitudinal axis joining the rearward portions of each of said side frameworks in spaced apart relationship; and G. at least one weighted cylinder rotationally mounted on said rear cross bar support member, said at least one weighted cylinder positioned to rest on said ground base to facilitate non-lateral relocation of position of said soccer goal framework by rotation of said at least one weighted cylinder on the ground base, said at least one weighted cylinder further positioned rearward of the center of gravity of said framework, said weighted roller comprising a hollow thick walled sealed cylinder fillable with ballast, said cylinder having a cylindrical outer surface bounded by two spaced apart roller face end members, said cylinder further comprising a framework member receiving hub disposed in the center of each of said end members; and means for attaching said rear support cross member to said side frameworks, said means for attaching comprising rotatable clamp members slideably mounted on said side frameworks and arranged to rotate about said longitudinal axis of said rear support cross member; and wherein said weighted cylinder is configured to:

i. inhibit the forward tipping and the shifting of said soccer goal framework over said playing field ground base;

ii. facilitate the relocation of the position of said soccer goal framework by rotation of said cylinder; and iii. prevent the removal of said cylinder from said soccer goal framework.

5. The soccer goal framework of claim 4 wherein said ballast comprises water.

6. The soccer goal framework of claim 4 wherein said ballast comprises sand.

7. In a soccer goal framework having a pair of spaced apart side frameworks, a rotatable weighted cylinder assembly comprising in combination:

A. at least one crossbar member arranged to be attached to and between the rearmost portions of said side frameworks;

B. at least one weighted cylinder mounted on said crossbar; and

C. means for attaching said rear support cross member to said side frameworks, said means for attaching comprising rotatable clamp members slideably mounted on said side frameworks and arranged to rotate about said longitudinal axis of said rear support cross member.

* * * * *